US009533820B2

(12) United States Patent
Tanbo et al.

(10) Patent No.: US 9,533,820 B2
(45) Date of Patent: Jan. 3, 2017

(54) CIGARETTE PACKAGE AND METHOD OF PRODUCING SAME

(75) Inventors: Hitoshi Tanbo, Tokyo (JP); Ryuichi Kashimura, Kyoto (JP); Naoto Bono, Tokyo (JP); Hiroyuki Yamashita, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 681 days.

(21) Appl. No.: 12/155,998

(22) Filed: Jun. 12, 2008

(65) Prior Publication Data

US 2009/0038965 A1 Feb. 12, 2009

Related U.S. Application Data

(63) Continuation of application No. PCT/JP2006/324371, filed on Dec. 6, 2006.

(30) Foreign Application Priority Data

Dec. 15, 2005 (JP) ..... 2005-361824

(51) Int. Cl.

| | |
|---|---|
| ***B65D 85/10*** | (2006.01) |
| ***B65D 5/54*** | (2006.01) |
| ***B65D 5/66*** | (2006.01) |
| ***B31B 3/00*** | (2006.01) |
| ***B65B 19/22*** | (2006.01) |
| ***B65D 5/42*** | (2006.01) |

(52) U.S. Cl.

CPC ..... *B65D 85/1036* (2013.01); *B31B 3/00* (2013.01); *B65B 19/228* (2013.01); *B65D 5/4266* (2013.01)

(58) Field of Classification Search

CPC ..... B65D 85/1036; B65D 2101/00; B65D 5/5425; B65D 5/6685; B65B 3/00; B65B 19/228

USPC ..... 206/268, 273; 229/149–151, 160.1, 237; 53/444, 456, 148, 564; 493/59, 60, 61, 62, 493/355

See application file for complete search history.

(56) References Cited

U.S. PATENT DOCUMENTS

| | | | | |
|---|---|---|---|---|
| 4,834,244 | A * | 5/1989 | Masui | 229/237 |
| 4,919,785 | A * | 4/1990 | Willey et al. | 229/207 |
| 4,949,841 | A * | 8/1990 | Focke et al. | 206/254 |
| 5,123,589 | A * | 6/1992 | Cote | 229/232 |
| 5,582,424 | A | 12/1996 | Okuyama et al. | |
| 6,199,687 | B1 * | 3/2001 | Tambo et al. | 206/268 |
| 6,360,943 | B1 * | 3/2002 | Focke et al. | 229/160.1 |
| 7,353,940 | B2 * | 4/2008 | Sendo | 206/268 |

(Continued)

FOREIGN PATENT DOCUMENTS

| | | |
|---|---|---|
| DE | 40 32 870 A1 | 4/1992 |
| EP | 0 895 940 A2 | 2/1999 |

(Continued)

*Primary Examiner* — Chun Cheung

(74) *Attorney, Agent, or Firm* — Birch, Stewart, Kolasch & Birch, LLP

(57) ABSTRACT

A cigarette package is provided with a box body and a tongue lid. The tongue lid includes a top wall and a tongue wherein the top wall closes an open end of the box body and the tongue overlies a front wall of the box body at the time the cigarette package is made, and connecting lugs in a pair joined to the opposite side edges of the tongue by side separation lines, respectively, and bonded to the opposite side faces of the box body, respectively. The side separation lines each has slits arranged at specified intervals and portions connecting the adjacent slits. The connecting portions are formed into fatigue joints by applying a load.

12 Claims, 12 Drawing Sheets

(56) References Cited

U.S. PATENT DOCUMENTS

2005/0241967 A1 11/2005 Sendo

FOREIGN PATENT DOCUMENTS

| | | | |
|---|---|---|---|
| JP | 6-67317 | U | 9/1994 |
| JP | 7-205742 | A | 8/1995 |
| JP | 7-300169 | A | 11/1995 |
| JP | 3049393 | U | 6/1998 |
| JP | 11-49134 | A | 2/1999 |
| JP | 2005-200105 | A | 7/2005 |
| WO | WO-2004/064550 | A1 | 8/2004 |

* cited by examiner

CIGARETTE PACKAGE AND METHOD OF PRODUCING SAME

This application is a Continuation of co-pending Application No. PCT/JP2006/324371 filed on Dec. 6, 2006, and for which priority is claimed under 35 U.S.C. §120; and this application claims priority of Application No. 2005-361824 filed in Japan on Dec. 15, 2005 under 35 U.S.C. §119; the entire contents of all are hereby incorporated by reference.

TECHNICAL FIELD

This invention relates to a cigarette package provided with an openable and closable lid, and a method of producing the same.

BACKGROUND ART

The cigarette package of this type comprises an inner pack and a parallelepiped outer box enclosing the inner pack. The inner pack includes a bundle of rod-shaped smoking articles, such as filter cigarettes, and an inner wrapper covering the bundle. The outer box includes a box body open at the upper end thereof, and a lid joined to the box body at a rear edge of the open end of the box body, which functions as a hinge. The outer box is formed by folding a blank around the inner pack.

The lid of the outer box can be a hinged lid in the shape of a box, or a tongue lid having a tongue. While the hinged lid is fitted on top of the open end of the box body, the tongue lid has an upper wall for covering the open end of the box body and a tongue extending from the upper wall designed such that when the upper wall closes the open end of the box body, the tongue overlies the front wall of the box body.

[Patent Document 1] Japanese Unexamined Patent Publication No. Hei 11-49134

It is desirable that at the time the above-described cigarette package is made, the lid of the outer box should be joined to the box body by a tearable separation line. The provision of such separation line is effective in deterring people from tampering with the cigarette package.

More specifically, when the lid is first opened, the lid is torn from the box body along the separation line, and the torn separation line leaves break marks to the box body as well as the lid, which marks indicate that the lid has already been opened.

Generally, the separation line is provided as a perforated line formed in the blank for the outer box in advance. The perforated line, i.e., the separation line has a lot of joins connecting the adjacent perforations. Thus, when the lid is first opened, first, a join at one end of the separation line suffers a break, and the adjacent joins suffer such break one after another, so that the separation line completely breaks. In other words, the separation line breaks in the manner that a crack spreads.

However, the crack does not infallibly spread along the separation line, but can spread deviating from the separation line. Such deviating crack can give an undesired break to the tongue lid and/or the box body, and therefore lead to a damaged appearance of the cigarette package opened.

Such trouble can be avoided by making the joins of the separation line shorter so that the joins can be broken easily. This can, however, cause a problem that in the process of making a cigarette package, specifically in folding the blank, the blank splits along the separation line so that the cigarette package fails to be made.

DISCLOSURE OF THE INVENTION

The primary object of the present invention is to provide a cigarette package which allows stable production in spite of the provision of a separation line, and which can ensure that when the lid is first opened, the outer box is separated into the box body and the lid infallibly along the separation line, and a method of producing the same.

In order to achieve the above object, a cigarette package according to the present invention comprises an inner pack including a bundle of rod-shaped smoking articles wrapped with an inner wrapper; and a parallelepiped outer box enclosing the inner pack, formed by folding a blank of paper around the inner pack, the outer box including a box body having an open end, a lid joined to the box body and capable of opening and closing the open end, and a parting line located at a boundary between the box body and the lid, and at the time the outer box is formed, connecting the box body and the lid separably, the parting line including perforations arranged in one direction at specified intervals and fatigued joints connecting the adjacent perforations.

Since the linkage of fibers constituting the blank is already broken at the locations of the fatigued joints of the parting line, the blank has a decreased tensile strength at the location of the parting line. Thus, when the lid is first opened, the lid is separated from the box body along the parting line easily and infallibly, and the lid or the box body does not suffer a crack deviating from the parting line.

In a desirable aspect, the parting line forms a fold line for the blank. In this case, when the blank is folded along the parting line, the linkage of fibers is further broken at the locations of the fatigued joints.

Specifically, the lid can be a tongue lid joined to the box body at a rear edge of the open end functioning as a hinge, where the tongue lid includes a top wall extending from the rear edge of the open end and adapted to close the open end, a tongue extending from the top wall and adapted to overlie the front wall of the box body at the time the outer box is formed, and connecting lugs in a pair bonded to the outer surfaces of the opposite side walls of the box body, and the parting line includes side separation lines each connecting a side edge of the tongue and the corresponding connecting lug separably.

When the tongue lid is separated from the box body along the side separation lines, the side separation lines leave break marks to the tongue lid as well as the box body. The provision of the separation lines leaving such break marks is effective in deterring people from tampering with the cigarette package.

The tongue lid may further include inner top flaps in a pair bonded to the inner surface of the top wall at the opposite ends of the top wall, and the parting line may further include top separation lines each connecting the side wall of the box body and the corresponding inner top flap separably. The provision of such inner top flaps in a pair not only facilitates the folding of the blank but also reinforces the top wall.

The present invention also provides a method of producing a cigarette package, which production method comprises a supply step in which a blank of paper for forming an outer box and an inner pack to be enclosed in the outer box are supplied to a folding station, respectively, the inner pack including a bundle of rod-shaped smoking articles and an inner wrapper covering the bundle; and a folding step in which the outer box having a structure described above is formed at the folding station by folding the blank around the inner pack, wherein said supply step includes a process of forming joins of a parting line into fatigued joints by applying a load to the parting line while the blank is being transported toward the folding station.

In a desirable aspect, the parting line forms a fold line for the blank, and the process is carried out in a manner such that the load is applied to the parting line by folding the blank along the parting line in the opposite direction to the direction that the blank is folded along the parting line at the folding station.

Specifically, when the parting line extends in the direction crossing a transport plane on which the blank is transported, the process can be carried out by using a fixed member and a movable member disposed apart from each other in the direction of transport of the blank and on the opposite sides of the transport plane, in a manner such that, with the parting line of the blank positioned between the fixed member and the movable member, the movable member is moved toward the opposite side of the transport plane to push the blank against the fixed member, so that the blank is folded along the parting line. In a desirable aspect, the process includes bringing the blank pushed and folded, back onto the transport plane.

When the parting line extends in the direction of transport of the blank, the process can be carried out by using a receiving member disposed near the transport plane on which the blank is transported and having a groove extending in the direction of transport, and a rotating member disposed opposite the receiving member with the transport plane between and having a tucker attached to the peripheral portion thereof, in a manner such that, with the parting line of the blank positioned at the location of the groove, the tucker is moved along the parting line by rotating the rotating member so that the tucker is pushed into the groove together with the parting line so that the blank is folded along the parting line. In a desirable aspect, the receiving member is a receiving roller rotatably supported and having a circumferential groove in the cylindrical surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
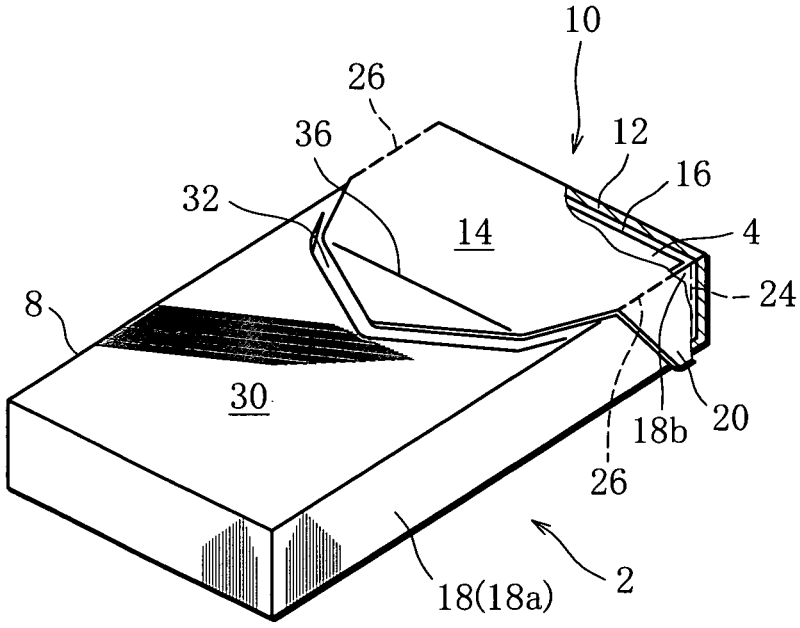
FIG. 1 is a perspective view showing an embodiment of a cigarette package, with a portion cut away.

FIG. is a diagram showing part of a tongue lid of FIG. 1 on an enlarged scale.

Figure 6:
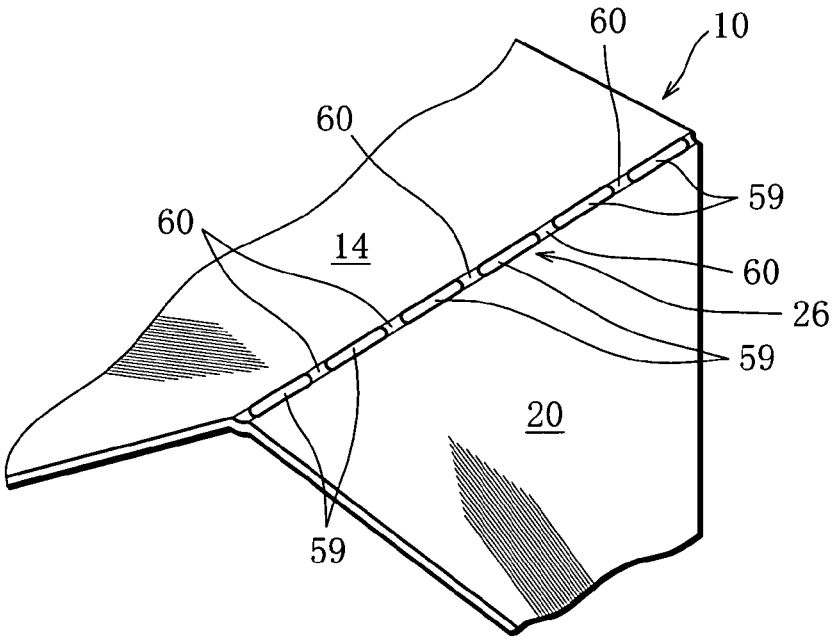
Figure 7:
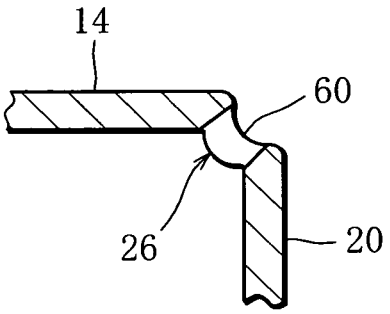

FIG. 7 is a cross-sectional view of a side separation line of FIG. 6.

Figure 8:
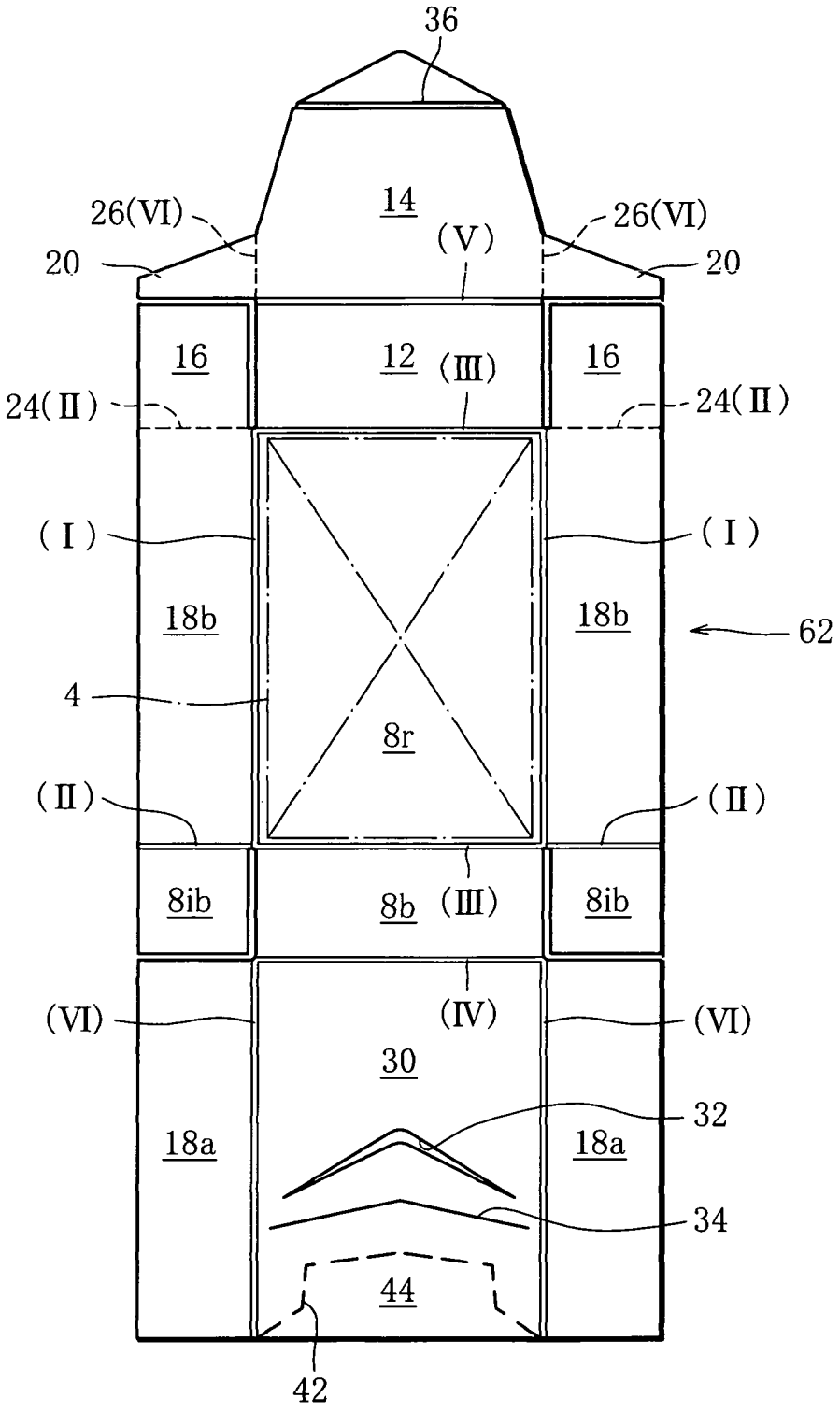

FIG. 8 is a diagram showing a blank for forming an outer box of FIG. 1 in an unfolded state.

Figure 9:
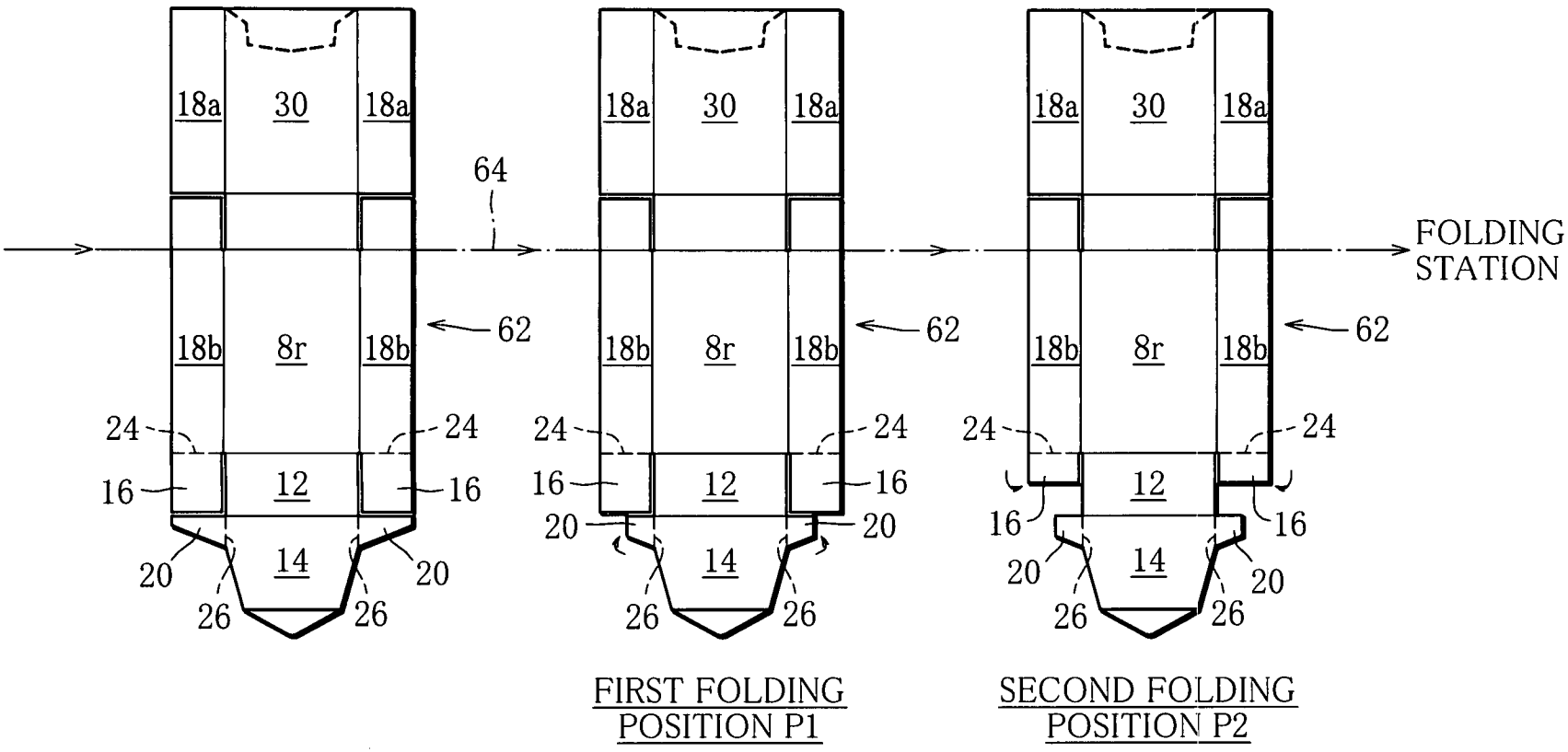

FIG. 9 is a diagram showing first and second folding positions set on a blank transport path.

Figure 10:
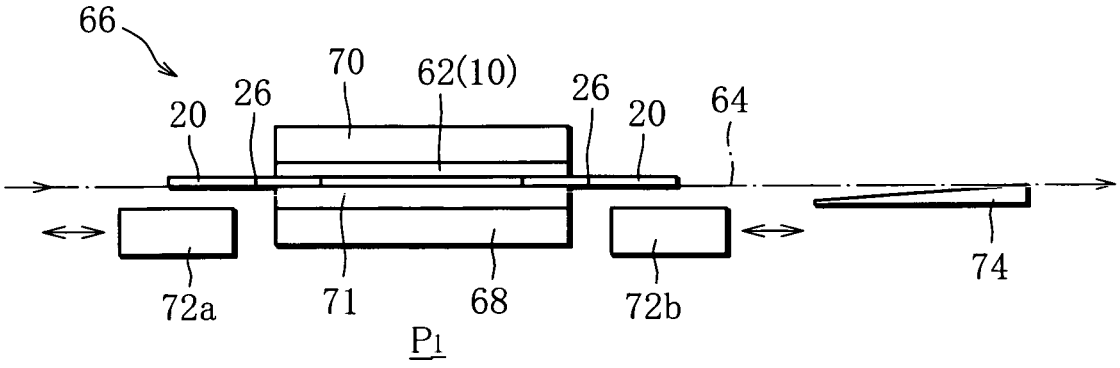

FIG. 10 is a diagram showing a first folding device disposed at the first folding position.

Figure 11:
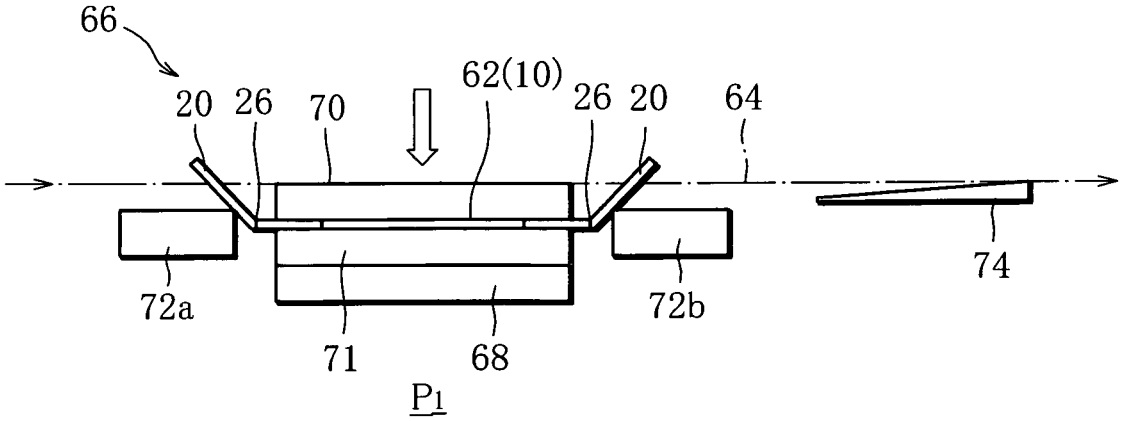

FIG. 11 is a diagram showing the device of FIG. 10 in an operative state.

Figure 12:
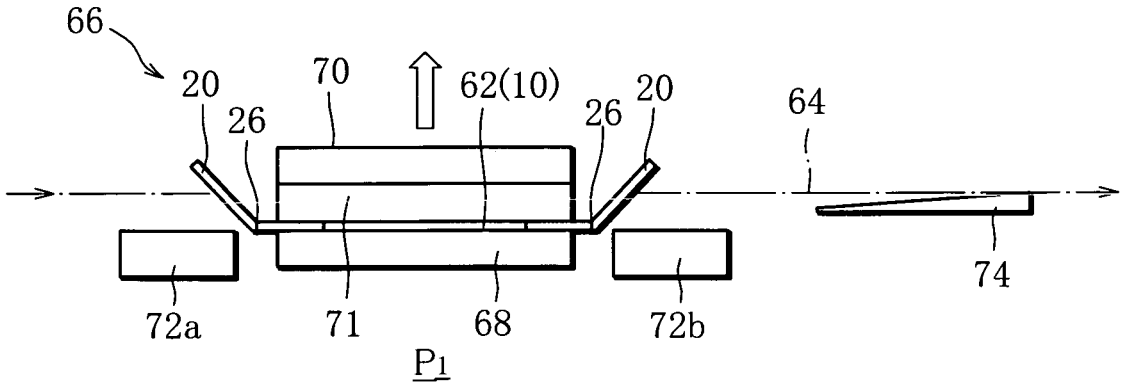

FIG. 12 is a diagram showing the device of FIG. 10 brought back from the operative state.

Figure 13:
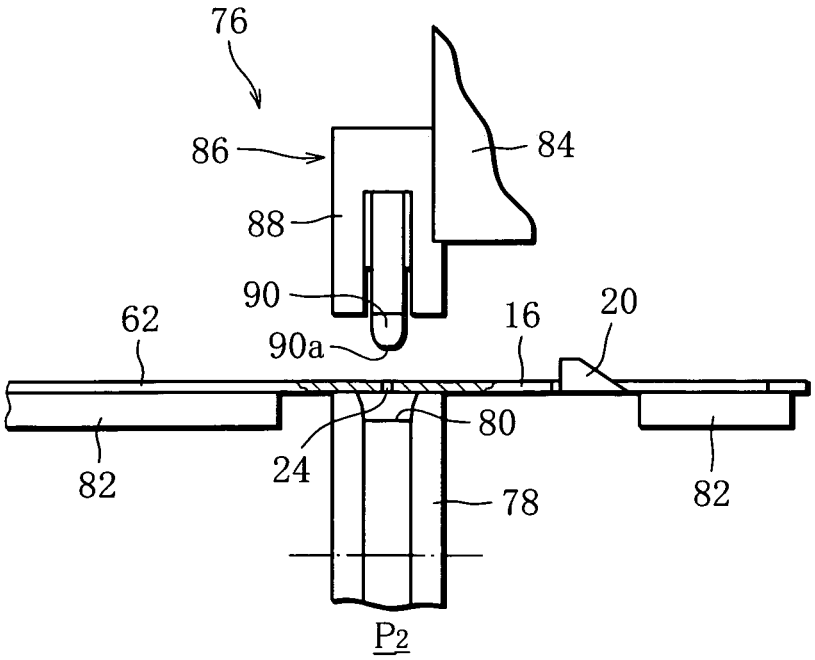

FIG. 13 is a diagram showing a second folding device disposed at the second folding position.

Figure 14:
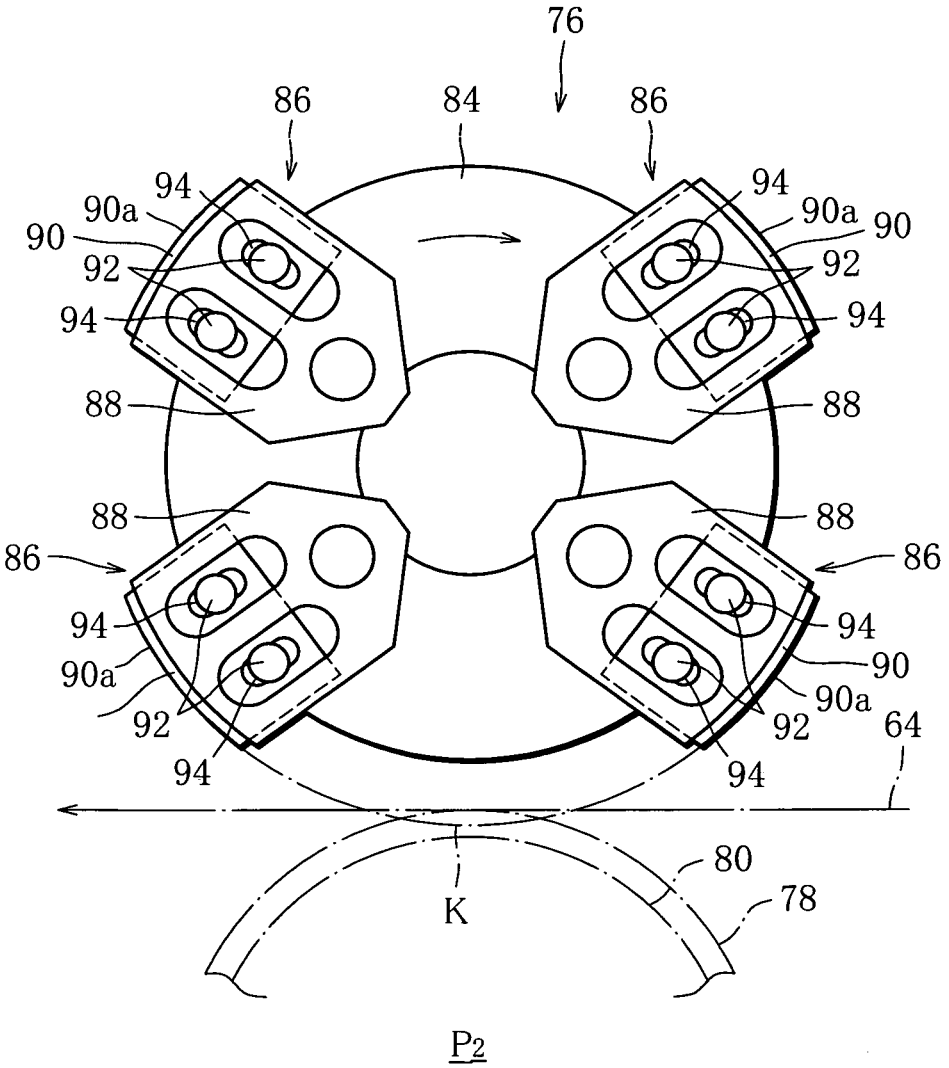

FIG. 14 is a diagram showing an end face of a rotating drum of the device of FIG. 13.

Figure 15:
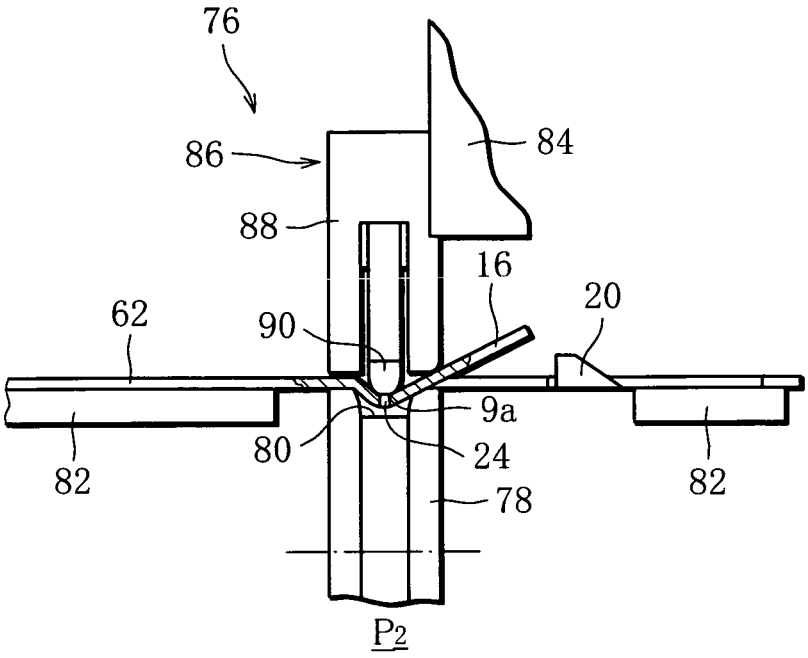

FIG. 15 is a diagram showing the device of FIG. 13 in an operative state.

Figure 16:
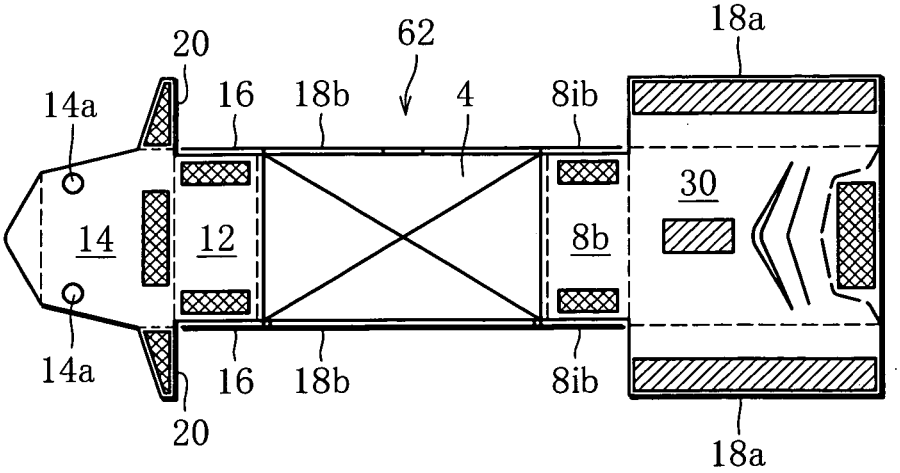

FIG. 16 is a diagram for explaining the process of folding the blank.

Figure 17:
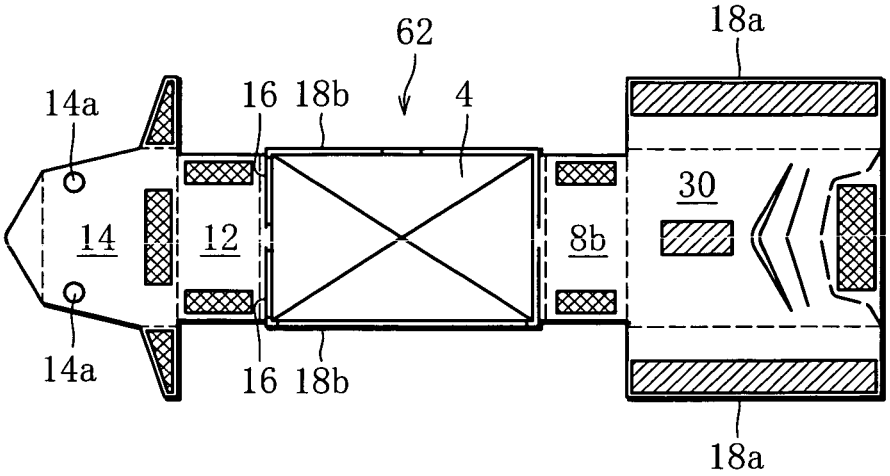

FIG. 17 is a diagram showing the state after a further folding operation is performed on the blank in the state of FIG. 16.

Figure 18:
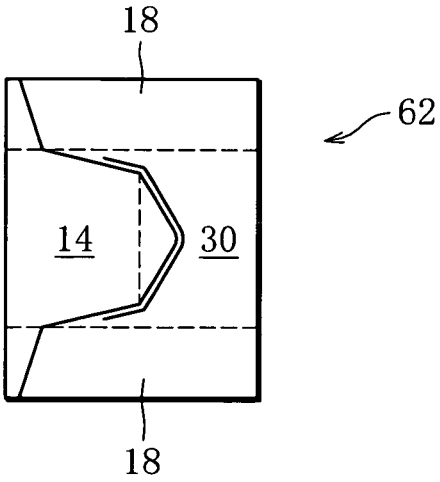

FIG. 18 is a diagram showing the state after a further folding operation is performed on the blank in the state of FIG. 17.

DETAILED DESCRIPTION OF THE PREFERRED EMBODIMENTS

Figure 2:
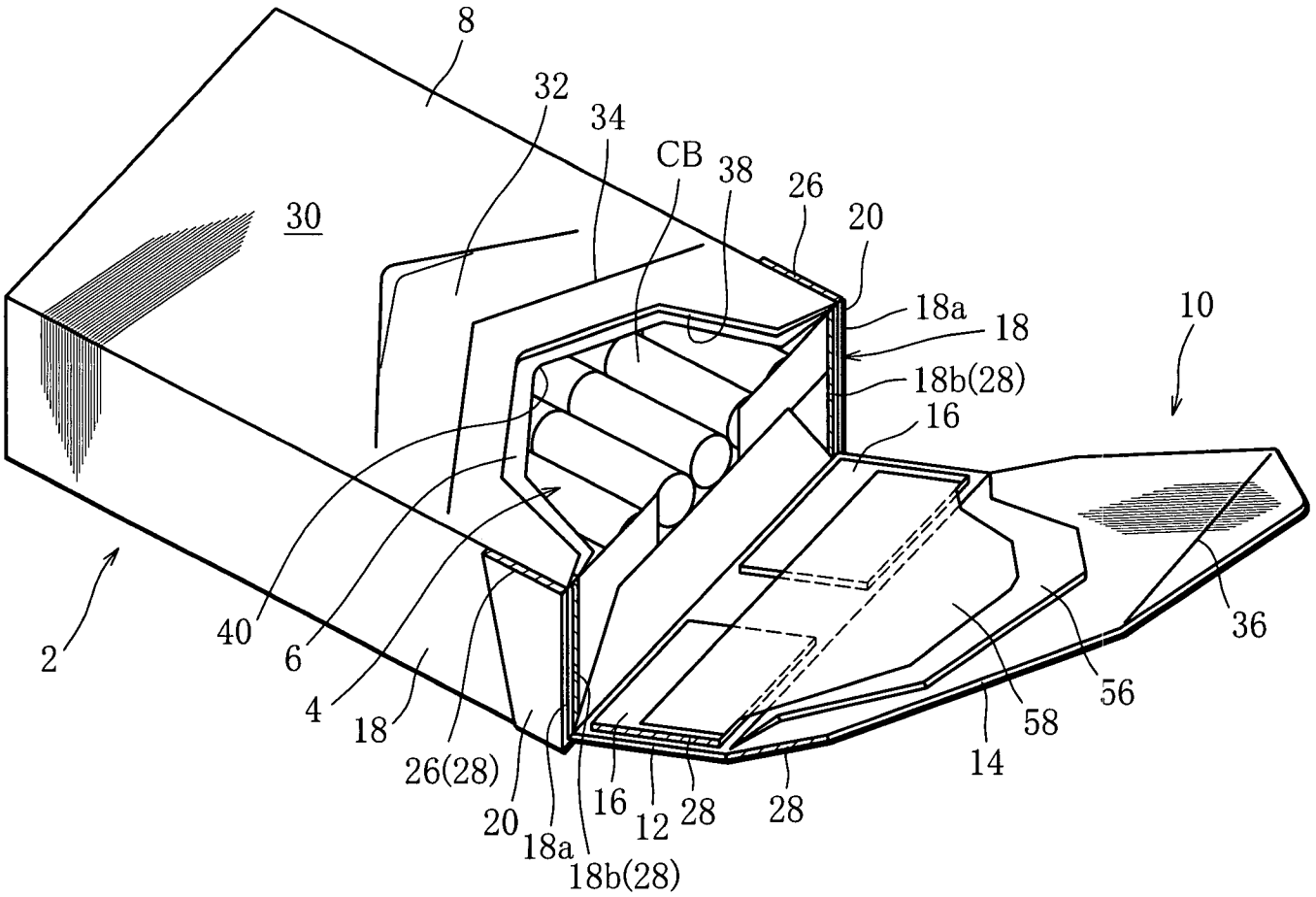
FIG. 2 is a perspective view showing the cigarette package of FIG. 1 in an open state.

FIG. 1 shows a tongue-lid cigarette package immediately after produced. FIG. 2 shows the cigarette package of FIG. 1 in an open state. As clear from FIG. 2, the cigarette package comprises a parallelepiped outer box 2 and an inner pack 4 enclosed in the outer box 2. The inner pack 4 includes a bundle of rod-shaped smoking articles such as filter cigarettes, which will be called a cigarette bundle CB, and an inner wrapper 6 covering the cigarette bundle CB.

An outer box 2 includes a box body 8, and the box body 8 is open at the upper end. The outer box 2 further includes a tongue lid 10, and the tongue lid 10 is joined to the box body 8 at a rear edge of the open end of the box body 8, which functions as a hinge. The tongue lid 10 has a top wall 12 for closing the open end of the box body 8, and a tongue 14 extending from the top wall 12. The tongue 14 has a tapered end.

When the cigarette package is in the state shown in FIG. 1, the top wall 12 of the tongue lid 10 covers the open end of the box body 8, and the tongue 14 of the tongue lid 10 overlies the front wall 30 of the box body 8.

The tongue lid 10 further includes inner top flaps 16 in a pair and connecting lugs 20 in a pair. The inner top flaps 16 in a pair are bonded to the inner surface of the top wall 12 at the opposite ends. The connecting lugs 20 in a pair are bonded to the outer surfaces of the side walls 18 of the box body 18, beside the open end of the box body 18, respectively.

More specifically, each side wall 18 has an outer wall **18*a* and an inner wall 18*b*. When the cigarette package is in the state shown in FIG. 1, each inner top flap 16 is joined to an upper edge of the inner wall 18*b* of the corresponding side wall 18 by a tearable top separation line 24, while each connecting lug 20 is joined to the corresponding side edge of the tongue 14 by a tearable side separation line 26. The top separation lines 24 and side separation lines 26** each consist of a perforated line.

As will be described later, the above-described outer box 2 is formed by folding a blank of paper, in which process, the top separation lines 24 and side separation lines 26 serve as fold lines.

When the tongue lid 10 of the cigarette package produced is first opened, namely, the tongue 14 of the tongue lid 10 is pulled up from the front wall 30 of the box body 2 and turned around the hinge, the tongue lid 10 is separated from the box body 8 along the top separation lines 24 and the side separation lines 26, as shown in FIG. 2.

Here, as marked with diagonal lines in FIG. 2, the separation along the side separation lines 26 leaves break marks 28 on the side edges of the tongue 14 as well as the connecting lugs 20 in a pair, and the separation along the top separations lines 24 leaves break marks 28 on the inner walls 18*b* and the inner top flaps 16. Even when the tongue lid 10 is closed after this, the break marks 28 on the tongue 14 and the connecting lugs 20 are exposed, namely visible from outside. Thus, the provision of the separation lines leaving the break marks 28 is effective in deterring people from tampering with the filter cigarettes.

As clear from FIG. 1, the front wall 30 of the box body 8 has a recess 32, and the recess 32 is similar in shape to the end portion of the tongue 14. Thus, in the process of producing the cigarette package, when the tongue 14 is laid on the front wall 30 of the box body 8, the recess 32 receives the end portion of the tongue 14, so that the end portion of the tongue 14 is prevented from protruding beyond the surface of the front wall 30.

Further, as clear from FIG. 2, the front wall 30 has a slit 34. The slit 34 is formed between the open end of the box body 8 and the recess 32, and has a V-shape spreading out from the recess 32 toward the open end of the box body 8.

When the tongue lid 10 is once opened and then closed, the tongue lid 10 is laid on the front wall 30 of the box body 8 with its end inserted into the interior of the box body 8 through the slit 34. Desirably, the tongue lid 10 may have a fold line 36 near the end of the tongue 14. When the end portion of the tongue 14 is bent toward the front wall 30 of the box body 8 along the fold line 36, the tongue lid 10 is more easily inserted into the slit 34.

Further, as clear from FIG. 2, when the tongue lid 10 is first opened, an approximately U-shaped notch 38 is formed in the front wall 30 of the box body, and at the same time an approximately U-shaped notch 40, similar to the notch 38, is formed in the inner wrapper 6 of the inner pack 4. The notches 38, 40 are continuous with the open end of the box body 8 and conformity with each other. Thus, the cigarette bundle CB of the inner pack 4 is allowed to be partly exposed in the notches 38, 40.

Figure 3:
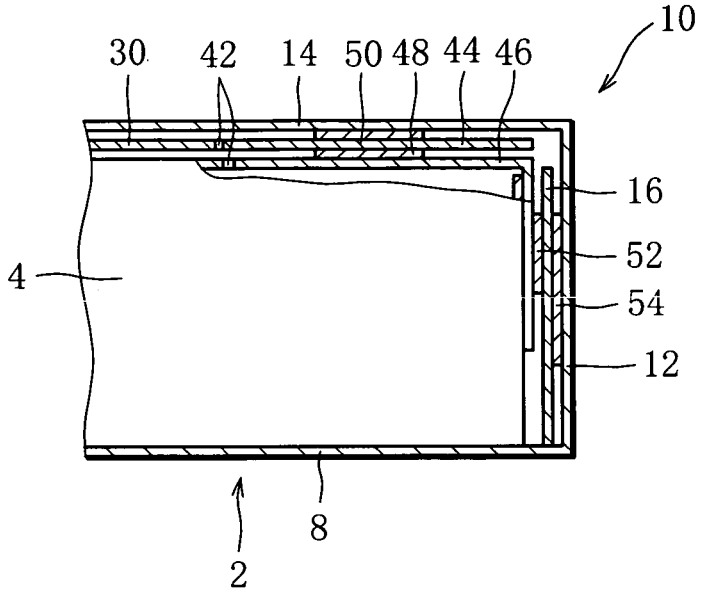
FIG. 3 is a vertical cross-sectional view showing part of the cigarette package of FIG. 1.
Figure 4:
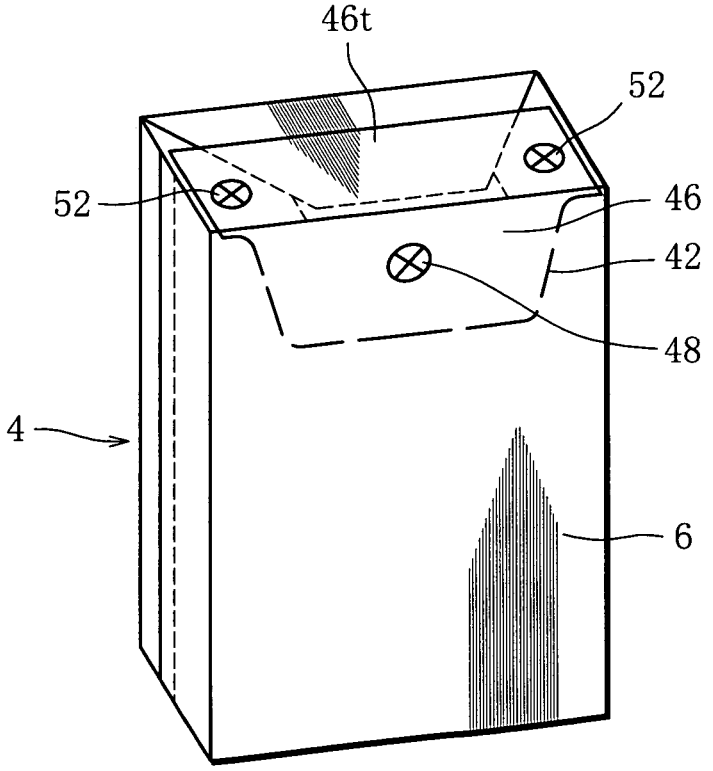
FIG. 4 is a perspective view showing an inner pack of FIG. 2.

As shown in FIGS. 3 and 4, for the notches 38, 40 to be formed, the front wall 30 and the inner wrapper 6 have separation lines 42, respectively. The separation lines 42 each consist of a row of holes or slits, and define to-be-separated portions 44, 46 corresponding to the notches 38, 40 on the front wall 30 and the inner wrapper 6, respectively. The to-be-separated portions 44, 46 are bonded together by an adhesive 48. Further, the to-be-separated portion 44 is bonded to the inner surface of the tongue 14 by an adhesive 50 and the to-be-separated portion 46 includes a top portion 46*t* bonded to the inner top flaps 16 in a pair by an adhesive 52.

In FIG. 3, reference sign 54 denotes an adhesive bonding the inner top flaps 16 and the top wall 12 of the tongue lid 10 together.

FIG. 4 clearly shows the shape of the to-be-separated portion 46 of the inner wrapper 6 and the positions of the adhesives 48, 52 applied on the to-be-separated portion 46.

Figure 5:
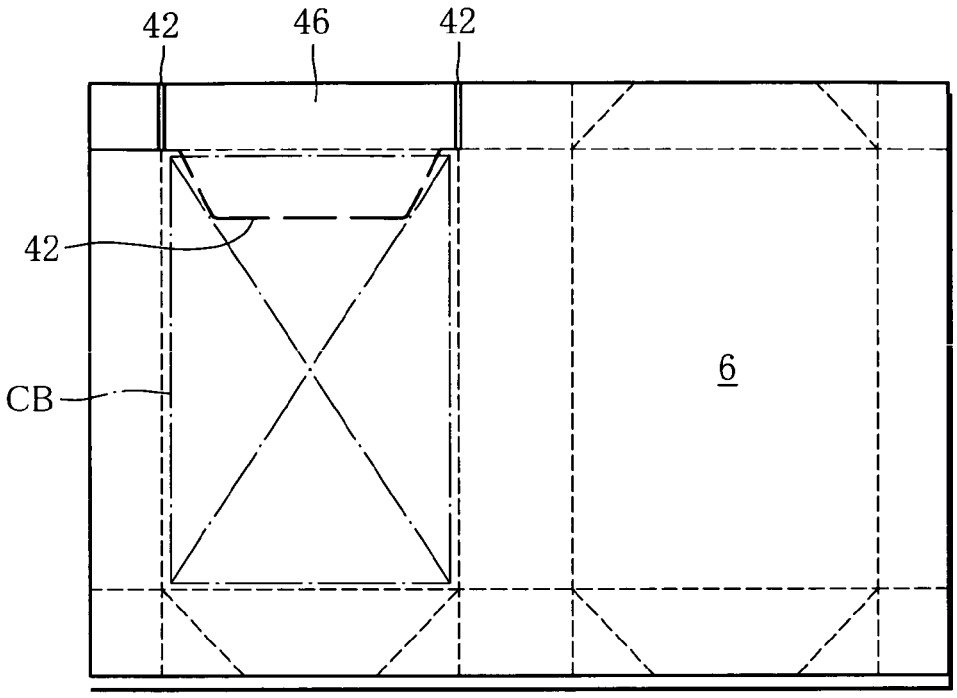
FIG. 5 is a diagram showing an inner wrapper of FIG. 4 in an unfolded state.

FIG. 5 shows the inner wrapper 6 in an unfolded state. The broken lines in FIG. 5 indicate fold lines produced on the inner wrapper 6 when the cigarette bundle CB is wrapped in the inner wrapper 6. In the present embodiment, the inner wrapper 6 includes glassine paper layers forming the outer and inner sides of the inner wrapper, and a paraffin wax layer between the glassine paper layers. The paraffin wax layer functions as a blocking layer, so that the inner wrapper 6 is higher in moisture-blocking capability as well as flavor-blocking capability, compared with aluminum-deposited paper. Thus, this embodiment of cigarette package does not require a film covering the outer box 2.

As mentioned above, when the tongue lid 10 is first opened, the to-be-separated portions 44, 46 of the front wall 30 and the inner wrapper 6 are separated from the front wall 30 and the inner wrapper 6 along the separation lines 42 to form separated pieces 56, 58, respectively. As clear from FIG. 2, the separated pieces 56, 58 are kept bonded to the inner surface of the tongue lid 10.

FIGS. 6 and 7 show the above-mentioned side separation line 26 on an enlarged scale.

The side separation line 26 consists of a perforated line, and the perforated line has alternating slits 59 and fatigued joints 60. The fatigued joints 60 are formed by applying a specified load to the side separation line 26 from the inner side of the blank.

Also the top separation line 24 consists of a perforated line similar to the side separation line 26 and has alternating slits and fatigued joints.

The linkage of fibers constituting the blank is broken at the locations of the top and side separation lines 24, 26, and such breaks about the linkage of fibers develop when the blank is folded along the top and side separation lines 24, 26. Thus, in the outer box 2 that has been formed from the blank, the fatigued joints 60 in the top and side separation lines 24, 26 have strength further decreased.

Thus, when the tongue lid 10 is first opened, a crack infallibly runs from one end to the other end of each of the separation lines 24, 26, breaking the fatigued joints 60, so that the tongue lid 10 is separated from the box body 8 in a good manner. As a result, undesired breaks deviating from the separation lines 24, 26 are not produced in the tongue lid 10 or the box body 8.

FIG. 8 shows a blank 62 for forming the above-described outer box 2.

The blank 62 includes a plurality of panels and flaps. These panels and flaps form the above-described box body 8 and tongue lid 10. The panels and flaps are assigned the same reference signs as those assigned to the corresponding constituting parts of the box body 8 and tongue lid 10. Reference signs 8*r*, 8*b*, 8*ib* in FIG. 8 denote a rear wall, a bottom wall, and inner bottom flaps for reinforcing the bottom wall, of the box body 8, respectively.

In FIG. 8, fold lines for the blank 62 other than the top and side separation lines 24, 26 are indicated in double thin lines, and reference signs (I) to (VI) indicate the order of folding of the blank 62 along the fold lines and separation lines 24, 26.

The above-mentioned fatigued joints 60 of the top and side separation lines 24, 26 are formed prior to folding the blank 62. How the fatigued joints 60 are formed will be explained below.

FIG. 9 shows a transport path 64 along which the blank 62 is transported. The transport path 64 extends horizontally toward a folding station. The blank 62 is placed on the transport path 64 with its outer side up. On the transport path 64, a first folding position $P_1$ and a second folding position $P_2$ are defined. At the first folding position $P_1$, fatigued joints 60 are formed in the side separation lines 26 of the blank 62, and at the second folding position $P_2$, fatigued joints 60 are formed in the top separation line 24 of the blank 62.

More specifically, at the first folding position $P_1$, the connecting lugs 20 in a pair of the blank 62 are folded toward the outer side of the blank 62, namely upward, along the side separation lines 26. This folding operation applies a load to the side separation lines 26 from the inner side of the blank 62, so that the portions between the slits 59 of the side separation lines 26 are formed into the fatigued joints 60.

Then, at the second folding position $P_2$, the inner top flaps 16 in a pair of the blank 62 are folded upward along the top separation lines 24. This folding operation forms the portions between the slits 59 of the top separation lines 24 into the fatigued joints 60.

FIG. 10 specifically shows a first folding device 66 for forming the fatigued joints 60 in the side separation lines 26.

The first folding device 66 includes movable plates 68, 70 in a pair. The movable plates 68, 70 are disposed below and above the transport path 64, respectively, parallel to the transport path 64, and capable of reciprocating vertically in a manner associated with each other. Specifically, a side edge of the movable plate 68 extending along the transport path and the corresponding side edge of the movable plate 70 are joined by a vertical plate 71.

Tuckers 72*a*, 72*b* in a pair are provided below the transport path 64. The tucker 72*a* is located immediately upstream of the movable plates 68, 70, while the tucker 72*b* is located immediately downstream of the movable plates 68, 70. When the movable plates 68, 70 in a pair are in a rest position as shown in FIG. 10, the tuckers 72*a*, 72*b* in a pair and the lower movable plate 68 are at the same height position.

The tuckers 72*a*, 72*b* in a pair are capable of reciprocating along the transport path 64, and by such reciprocation, the distance between each tucker 72 and the movable plates 68, 70 is adjusted.

Downstream of the tucker 72*b*, a transport guide 74 is provided. The transport guide 74 is located immediately below the transport path 64.

As shown in FIG. 10, at the time the blank 62 has been transported to the first folding position $P_1$, the part of the blank 62 intended to form the tongue 14 of the tongue lid 10, i.e., the tongue panel is located between the movable plates 68, 70, and the left and right side separation lines 26 and connecting lugs 20 of the blank 62 are located upstream and downstream of the movable plates 68, 70, respectively. Here, it is to be noted that the side separation lines 26 extend in the direction crossing the transport plane on which the blank 26 is transported.

When the movable plates 68, 70 in a pair are moved down from the position shown in FIG. 10, the upper movable plate 70 pushes down the tongue panel with the connecting lugs 20 in a pair, in this process, the tuckers 72*a*, 72*b* in a pair contact the connecting lugs 20, respectively, thereby preventing the connecting lugs 20 from moving down. Consequently, as shown in FIG. 11, the connecting lugs 20 are folded along the side separation lines 26, respectively, so that the fatigued joints 60 are formed in the side separation lines 26.

It is to be noted that the tongue panel is pushed down in a manner that the blank 62 is folded along the fold line between the panel intended to form the rear wall 8*r* and the panel intended to form the top wall 12, or in other words, along the hinge line. The angle to which the connecting lug 20 is folded, therefore the load applied to the side separation line 26 is determined by the distance between the tucker 72 and the movable plate 70.

Then, as shown in FIG. 12, the movable plates 68, 70 are moved up to return to the rest position, where the lower movable plate 68 brings the tongue panel back to the same level as the tuckers 72*a*, 72*b*. Thus, after this, when the blank 62 is again transported along the transport path 64, the blank 62, specifically the folded connecting lugs 20 are not obstructed by the downstream tucker 72*b*. Guided by the transport guide 74, the blank 26 moves toward the subsequent second folding position $P_2$.

It can be arranged that the movable plate 68 in the rest position and the tuckers 72*a*, 72*b* are located immediately under the transport path 64. In this case, the plate 68 and tuckers 72 serve as blank 62 transport guides.

FIG. 13 shows a second folding device 76 provided at the second folding position $P_2$.

The second folding device 76 includes a receiving roller 78, and the receiving roller 78 is located immediately below the transport path 64. The receiving roller 78 is supported rotatably, and guides the transport of the blank 62 with its cylindrical surface. The cylindrical surface has a circumferential groove 80. In FIG. 13, the one-dot chain line indicates the rotation axis of the receiving roller 78, and reference sign 82 denotes a guide member defining the transport path 64.

Above the receiving roller 78, a rotating drum 84 is located. A plurality of tucker blocks 86 are attached to the peripheral portion of the rotating drum 84. As clear from FIG. 14, the tucker blocks 86 are arranged along the circumference of the rotating drum 84, at specified intervals, and projects radially outward beyond the cylindrical surface of the rotating drum 84.

More specifically, each tucker block 86 includes a holder 88 fixed to the rotating drum 84 and a tucker 90 held by the holder 88. The tucker 90 projects radially outward of the rotating drum 84, beyond the holder 88. The projection of the tucker 90 is adjustable by means of adjusting screws 92 and slots 94. The tucker 90 has a circular arc surface 90*a* at the projecting end. The trajectory K described by the circular arc surface 90*a* when the rotating drum 84 is rotated is partly under the transport path 64.

The blank 62 is transported to the second folding position $P_2$, and one of the top separation lines 24 of the blank 62 arrives right above the circumferential groove 80 in the receiving roller 78 as shown in FIG. 13. Here, it is to be noted that the top separation lines 24 extends in the direction of transport of the blank 62.

On the other hand, immediately before the top separation line 24 arrives at the position of the circumferential groove 80, intermittent rotation of the rotating drum 84 is started, and at the same time as the top separation line 24 arrives, the tucker 90 of one of the tucker blocks 86 passes along the top separation line 24, where, as shown in FIG. 15, the tucker 90 pushes the top separation line 24 into the circumferential groove 80 of the receiving roller 78, thereby folding the associated inner top flap 16 upward along the top separation line 24. Thus, a load is applied to the top separation line 24 from the inner side of the blank 62, so that the fatigued joints 60 are formed in the top separation line 24.

Since the tucker 90 passes along the top separation line 24 while the receiving roller 78 is guiding the transport of the blank 62, the blank 62 does not undergo an excessive load.

Then, the blank 62 is transported along the transport path 64 for the distance corresponding to the distance between the inner top flaps 16 in a pair, so that the other top separation line 24 is positioned right above the circumferential groove 80 in the roller 78. At the same time as the other top separation line 24 is thus positioned, the tucker 90 of the next tucker block 90 passes along this top separation line 24, pushing it into the circumferential groove 80. Consequently, the fatigued joints 60 are formed also in this top separation line 24 in the same manner.

Then, the blank 62 is further transported along the transport path 64 toward the folding station. At the folding station, the blank 62 is folded around the inner pack 4 according to the process shown in FIGS. 16 to 18.

First, as shown in FIG. 16, the inner pack 4 is supplied onto the inner side of the blank 62. The inner pack 4 is placed on the rear wall panel 8*r* of the blank 62, and the left and right side flaps 18*b* are each folded toward the corresponding side face of the inner pack 4, together with the associated inner top flap 16 and inner bottom flap 8*ib*, to overlie the corresponding side face of the inner pack.

Then, as shown in FIG. 17, the inner top flaps 16 and the inner bottom flaps 8*ib* are folded toward the inner pack 4 to overlie the top face and bottom face of the inner pack 4, respectively.

Then, together with the tongue panel 14, the top wall panel 12 is folded toward the top face of the inner pack 4 so that the top wall panel 12 overlies the inner top flaps 16. At the same time as the top wall panel 12 is folded, the bottom wall panel 8*b* with the front wall panel 30 is folded toward the bottom face of the inner pack 4 so that the bottom wall panel 8*b* overlies the inner bottom flaps 8*ib*.

Then, the front wall panel 30 with the left and right side flaps 18*a* is folded toward the inner pack 4 so that the front wall panel 30 overlies the front face of the inner pack 4. Later than the front wall panel 30 is folded, the tongue panel 14 with the left and right connecting lugs 20 is folded toward the inner pack 4 so that the tongue panel 14 overlies the front wall panel 30 and the connecting lugs 20 overlie the side flaps 18*a*, respectively, as shown in FIG. 18.

Last, the left and right side flaps 18*a* with the left and right connecting lugs 20 on are folded toward the inner pack 4 so that the side flaps 18*a* with the connecting lugs 20 overlie the side flaps 18*b*, respectively. With this, the production of the cigarette package is completed.

In FIGS. 16 and 17, hatching and cross-hatching are used to indicate the areas where an adhesive is applied. Apart from this, the tongue panel 14 is bonded to the front wall panel 30 by an adhesive 14*a* allowing detachment.

In the above-described method of producing the cigarette package, prior to folding the blank 62, the fatigued joints 60 are formed in the top and side separation lines 24, 26 of the blank 62 in the above-described manner. The linkage of fibers constituting the blank 62 are broken at the locations of the fatigued joints, so that the fatigued joints 60 are lower in tensile strength than the other part of the blank 62. After this, when the inner top flaps 16 and connecting lugs 20 are folded along the top and side separation lines 24, 26, respectively, breaks about the linkage of fibers at the locations of the fatigued joints 60 of the top and side separation lines 24 further develop.

The present invention is not limited to the above-described embodiment but can be modified in various ways.

For example, the present invention is applicable not only to the tongue-lid cigarette package but also to common hinged-lid cigarette packages in a similar manner. Further, it may be arranged such that before the fatigued joints 60 in the side separation lines 26 are formed, the fatigued joints 60 in the top separation lines 24 are formed. Further, the cigarette package according to the present invention may be provided with only the side separation lines 26 of the top and side separation lines 24, 26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A cigarette package, comprising:

an inner pack having an inner wrapper, a parallelepiped outer box enclosing said inner pack, said outer box being made of a paper blank, said outer box including:

a box body having an open end, a tongue lid joined to the box body and capable of opening and closing the open end, said tongue lid being joined to the box body at a rear edge of the open end and functioning as a hinge, the tongue lid including a top wall extending from the rear edge of the open end and adapted to close the open end, and said tongue lid further including inner top flaps in a pair bonded to an inner surface of the top wall at the opposite ends of the top wall, a tongue extending from the top wall and adapted to overlie a front wall of said box body at the time said outer box is formed, connecting lugs in a pair, bonded to the outer surfaces of opposite side walls of said box body, a corner boundary connecting the box body and the lid, said corner boundary being formed by folding the paper blank along a folding line and having an outer concave face and an inner convex face, and a parting line formed on the folding line of said corner boundary connecting the box body and the lid separably, the parting line defining side separation lines each connecting a side edge of the tongue and the corresponding connecting lug separably, and top separation lines each connecting the side wall of said box body and the corresponding inner top flap, said parting line having perforations arranged in one direction at specified intervals, and connecting portions connecting the adjacent perforations, wherein each of the connecting portions has an outer face and an inner face corresponding to the outer concave face and the inner convex face of said corner boundary, respectively, and linkage of fibers constituting the paper blank at the connecting portions is broken with respect to a direction across the parting line so that the connecting portions are formed as fatigued joints.

2. The cigarette package of claim 1, wherein the inner convex face of the connecting portions faces the inner pack.

3. A method of producing a cigarette package, comprising:

a supply step in which a blank of paper for forming a parallelepiped outer box and an inner pack to be enclosed in the outer box are supplied to a folding station, respectively, the inner pack including a bundle of rod-shaped smoking articles and an inner wrapper covering the bundle, and a folding step in which the outer box is formed at the folding station by folding the blank around the inner pack, the outer box including a box body having an open end, a lid joined to the box body and capable of opening and closing the open end, and a parting line located at a boundary between the box body and the lid, and at the time the outer box is formed, connecting the box body and the lid separably, the parting line including perforations arranged in one direction at specified intervals and joins connecting the adjacent perforations, wherein said supply step includes a process of forming the joins of the parting line into fatigued joints by applying a load to the parting line while the blank is being transported toward the folding station.

4. The production method according to claim 3, wherein the parting line forms a fold line for the blank, and said process is carried out in a manner such that the load is applied to the parting line by folding the blank along the parting line in the opposite direction to the direction that the blank is folded along the parting line at the folding station.

5. The production method according to claim 4, wherein the parting line extends in the direction crossing a transport plane on which the blank is transported, and said process is carried out by using a fixed member and a movable member disposed apart from each other in the direction of transport of the blank and on the opposite sides of the transport planes, in a manner such that, with the parting line positioned between the fixed member and the movable member, the movable member is moved toward the opposite side of the transport plane to push the blank against the fixed member, so that the blank is folded along the parting line.

6. The production method according to claim 5, wherein said process includes bringing the blank pushed and folded, back onto the transport plane.

7. The production method according to claim 4, wherein the parting line extends in the direction of transport of the blank, and said process is carried out by using a receiving member disposed near a transport plane on which the blank is transported and having a groove extending in the direction of transport, and a rotating member disposed opposite the receiving member with the transport plane between and having a tucker attached to the peripheral portion thereof, in a manner such that, with the parting line of the blank positioned at the location of the groove, the tucker is moved along the parting line by rotating the rotating member so that the tucker is pushed into the groove together with the parting line so that the blank is folded along the parting line.

8. The production method according to claim 7, wherein the receiving member is a receiving roller rotatably supported and having a circumferential groove in a cylindrical surface thereof.

9. A cigarette package, comprising:

an inner pack having an inner wrapper, a parallelepiped outer box enclosing said inner pack, said outer box being made of a paper blank, said outer box including:

a box body having an open end, a lid joined to the box body and capable of opening and closing the open end, a corner boundary connecting the box body and the lid, said corner boundary being formed by alternately folding the paper blank along a folding line so that said corner boundary has an outer concave face and an inner convex face, and a parting line formed on the folding line of said corner boundary connecting the box body and the lid separably, the parting line having perforations arranged in one direction at specified intervals, and connecting portions connecting the adjacent perforations, wherein each of the connecting portions has an outer face and an inner face corresponding to the outer concave face and the inner convex face of said corner boundary, respectively, and linkage of fibers constituting the paper blank at the connecting portions is broken with respect to a direction across the parting line so that the connecting portions are formed as fatigued joints.

10. The cigarette package according to claim 9, wherein the lid is a tongue lid joined to the box body at a rear edge of the open end functioning as a hinge, the tongue lid including a top wall extending from the rear edge of the open end and adapted to close the open end, a tongue extending from the top wall and adapted to overlie a front wall of said box body at the time said outer box is formed, and connecting lugs in a pair bonded to the outer surfaces of opposite side walls of said box body, and the parting line includes side separation lines each connecting a side edge of the tongue and the corresponding connecting lug separably.

11. The cigarette package according to claim 9, wherein the tongue lid further includes inner top flaps in a pair bonded to an inner surface of the top wall at the opposite ends of the top wall, and the parting line further includes top separation lines each connecting the side wall of said box body and the corresponding inner top flap.

12. A cigarette package comprising:

a parallelepiped box body having an open end, a lid joined to the box body and capable of opening and closing the open end, said lid provided with a tongue which is adapted to overlie a front wall of the box body, said tongue containing connecting lugs laterally extending from opposite sides of the tongue for bonding to the box body side walls, a corner boundary connecting the box body and the lid, said corner boundary being formed by a parting line having perforations arranged in one direction at specified intervals and connecting portions connecting the adjacent perforations, said connecting portions defining fatigue joints having an outer concave face and an inner convex face, whereby, folding along the parting line causes a further breaking of the linkage of fibers at the locations of the fatigued joints, enabling the lid to be effectively separated from the box body along the parting lines.

* * * * *